US007497320B2

(12) United States Patent
Heimsoth

(10) Patent No.: US 7,497,320 B2
(45) Date of Patent: Mar. 3, 2009

(54) DEVICE FOR FEEDING SACHETS ONTO A LINEAR TRANSPORT

(75) Inventor: Andreas Heimsoth, Walsrode (DE)

(73) Assignee: Fresenius Kabi Deutschland GmbH, Frankfurt (DE)

( * ) Notice: Subject to any disclaimer, the term of this patent is extended or adjusted under 35 U.S.C. 154(b) by 26 days.

(21) Appl. No.: 10/488,505

(22) PCT Filed: Sep. 18, 2002

(86) PCT No.: PCT/EP02/10485

§ 371 (c)(1),
(2), (4) Date: Sep. 21, 2004

(87) PCT Pub. No.: WO03/024851

PCT Pub. Date: Mar. 27, 2003

(65) Prior Publication Data

US 2005/0040011 A1 Feb. 24, 2005

(30) Foreign Application Priority Data

Sep. 20, 2001 (DE) ..... 101 46 468

(51) Int. Cl.
*B65G 47/00* (2006.01)

(52) U.S. Cl. ..... 198/457.01

(58) Field of Classification Search ..... 198/457.01
See application file for complete search history.

(56) References Cited

U.S. PATENT DOCUMENTS

| | | | | |
|---|---|---|---|---|
| 2,177,460 | A | 10/1939 | Renz | |
| 4,201,377 | A | 5/1980 | Honegger | |
| 5,503,386 | A | 4/1996 | Straessler et al. | |
| 6,098,978 | A | 8/2000 | Bielefeld et al. | |
| 6,575,447 | B2 * | 6/2003 | Yoshie et al. | 270/58.07 |

FOREIGN PATENT DOCUMENTS

| | | |
|---|---|---|
| CH | 660 719 A5 | 6/1987 |
| DE | 2141 340 | 2/1973 |
| GB | 1087997 | 10/1967 |

* cited by examiner

*Primary Examiner*—Gene Crawford
*Assistant Examiner*—Leslie A Nicholson, III
(74) *Attorney, Agent, or Firm*—David S. Safran; Roberts Mlotkowski Safran & Cole, P.C.

(57) ABSTRACT

The invention relates to a device for the handover of bags (1) to a linear transport system (2). With a view to precise handover at high cycle frequency, such a device is advantageously designed in that a feed station (5) for individually feeding the bags (1) onto a lower transport belt (7) of the linear transport system (2), and a raisable press-on element (8) above the lower transport belt (7) are provided.

16 Claims, 2 Drawing Sheets

DEVICE FOR FEEDING SACHETS ONTO A LINEAR TRANSPORT

Figure 1:
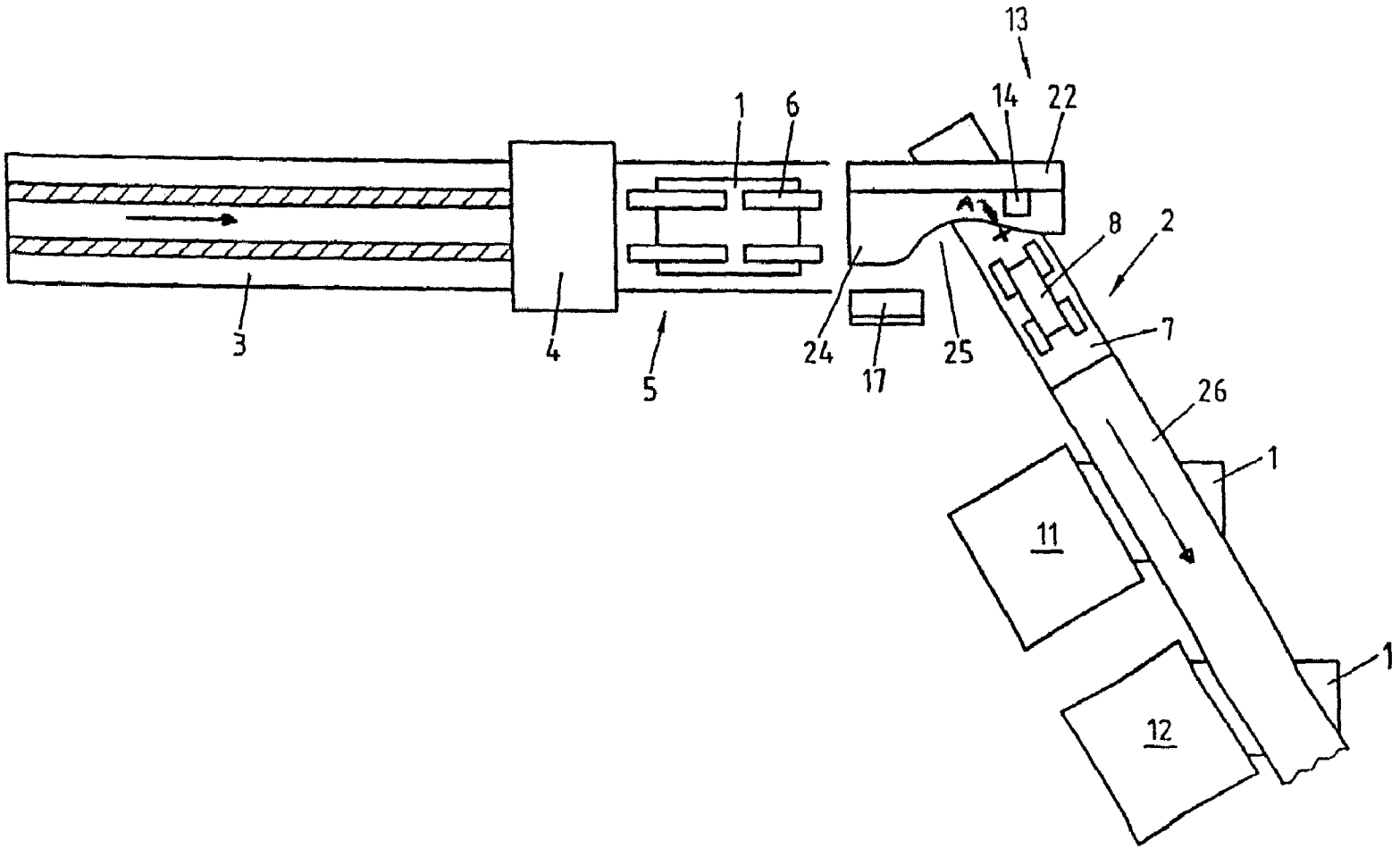

The invention relates to a device for the handover of bags to a linear transport system.

The transport of bags, which for example are processed by sealing-in pouring spouts into these bags, by means of a linear transport system, is known from a commonly owned U.S. patent application Ser. No. 10/488,505 which is now Patent Application Publication No. 2005/0040013.

The bags at issue are used for packaging goods which are dischargeable or free-flowing, i.e fillable. As a rule, such bags comprise a multi-layer plastic composite material. Such bags are in particular gaining increased use as butt-ended bags because, due to their flexible outer skin, they offer considerable advantages during transport of the full bags and during disposal of the empty bags.

Sealing-in pouring spouts in such bags is known from the state of the art in a multitude of embodiments. Basically, for sealing-in the pouring spout, the bag may first have to be cut, then opened so as to make it possible to insert the pouring spout into the opening in the bag, wherein after this, the pouring spout, which is then located in the bag opening, is tightly sealed to the bag by means of sealing jaws.

As a rule, the devices, known from the state of the art, for sealing-in pouring spouts in bags operate in cycles with the bags in the device being transported on a circuit. Such movement on a circuit is the usual method because as a rule the bags are held by means of grippers, which after picking up and processing the bags have to be transported back to their point of pickup.

From the above-mentioned parallel patent application, the use of a linear transport system for the bags, which transport system is formed by two transport belts, for sealing-in pouring spouts, is known.

Starting from the above-mentioned explanations, it is the object of the present invention to provide a device for the handover of bags to a linear transport system, which device ensures precise handover at high cycle frequency.

According to the invention, the above-derived and shown object is met in that a feed station for individually feeding the bags onto a lower transport belt of the linear transport system, and a raisable press-on element above the lower transport belt are provided.

The feed station comprises systems which are known from the state of the art and which are well proven and reliable systems for singling out and feeding in flat products; systems such as for example those made by the company KÖRA-Packmat.

By means of the feed station, according to the invention the singled out bags are transported at a high cycle frequency to a lower transport belt of the linear transport system. Such transport takes place while the press-on element is raised. After completion of the feed cycle, the press-on element is lowered onto the bag and presses said bag against the lower transport belt so that during the next transport movement of the transport belt the bag is transported into the belt gap between the two transport belts of the linear transport system. As a result of a simple design of the device according to the invention, high cycle frequencies can be achieved.

It is imaginable that the raisable press-on element is realised by means of the upper transport belt of the belt transport system. However, due to the considerable acceleration forces acting on the transport belts, and due to the required bearing arrangement, this is problematic. By providing the raisable press-on element with at least one roller, sufficiently safe handover of the pressed-on bag into the belt gap is ensured with a simple design. The use of a rigid press-on element is also imaginable, wherein, due to the friction in the belt gap, which friction is generated between the press-on element and the lower transport belt during the transport from the gap, damage to the surface of the bag cannot be excluded.

By arranging the device for the handover of bags on a table which is swivellable in relation to the linear transport system, the bags can be handed over to the linear transport system at any desired angle. This angle is determined by the angle at which the pouring spout is to be sealed-in in the bag relative to the transport of the bag by means of the feed station.

In order to ensure precise positioning of the bags on the lower transport belt, the device according to the invention should comprise a limit stop in the feed direction of the bags. Advantageously, the device according to the invention is designed in such a way that a raisable limit stop is provided in the feed direction of the bags. The option of raising the limit stop ensures that even at angles other than 90° angles between the device according to the invention and the linear transport system, damage to the corner of the bag which rests against the limit stop is safely avoided. During infeed of the bags, the limit stop is lowered; after completion of infeed, said limit stop is raised so as to prevent blocking the corner of the bag which rests against the limit stop, during transport.

According to a further embodiment, precise positioning of the bags across the feed direction is ensured in that a lowerable centring limit stop is provided which essentially operates across the feed direction of the bags. By means of this centring limit stop, the bags, which are transported by the feed station onto the upper transport belt, are precisely centred by moving the limit stop in the direction across the feed direction between the centring limit stop and a closing limit stop which is arranged on the opposite side of the bags. Such centring is of importance for the bags in particular in view of the cycled movement of the transport belts and of exact positioning of the bags transported in the transport belts, relative to the processing stations.

In order to ensure safe guidance of the bags during infeed by means of the feed station, below the lower transport belts and the raisable press-on element, an upper guide element is provided which forms a feed gap with the lower transport belt. This guide element cannot be raised; it forms a feed gap with the lower transport belt, which feed gap may be adjustable but which is fixed during infeed of the bags.

Providing a lower guide sheet, at least in some sections, between the guide element and the lower transport belt ensures transportation of the bags to the desired position during infeed, at first essentially without contacting the lower transport belt. This is advantageous for exact positioning since, for transport, the surface of the transport belts expediently has a high sliding friction coefficient, which is however not helpful for exact positioning during handover. Preferably, contact between the bag and the transport belts is only established after positioning is completed, by means of the lowerable press-on element.

Figure 2:
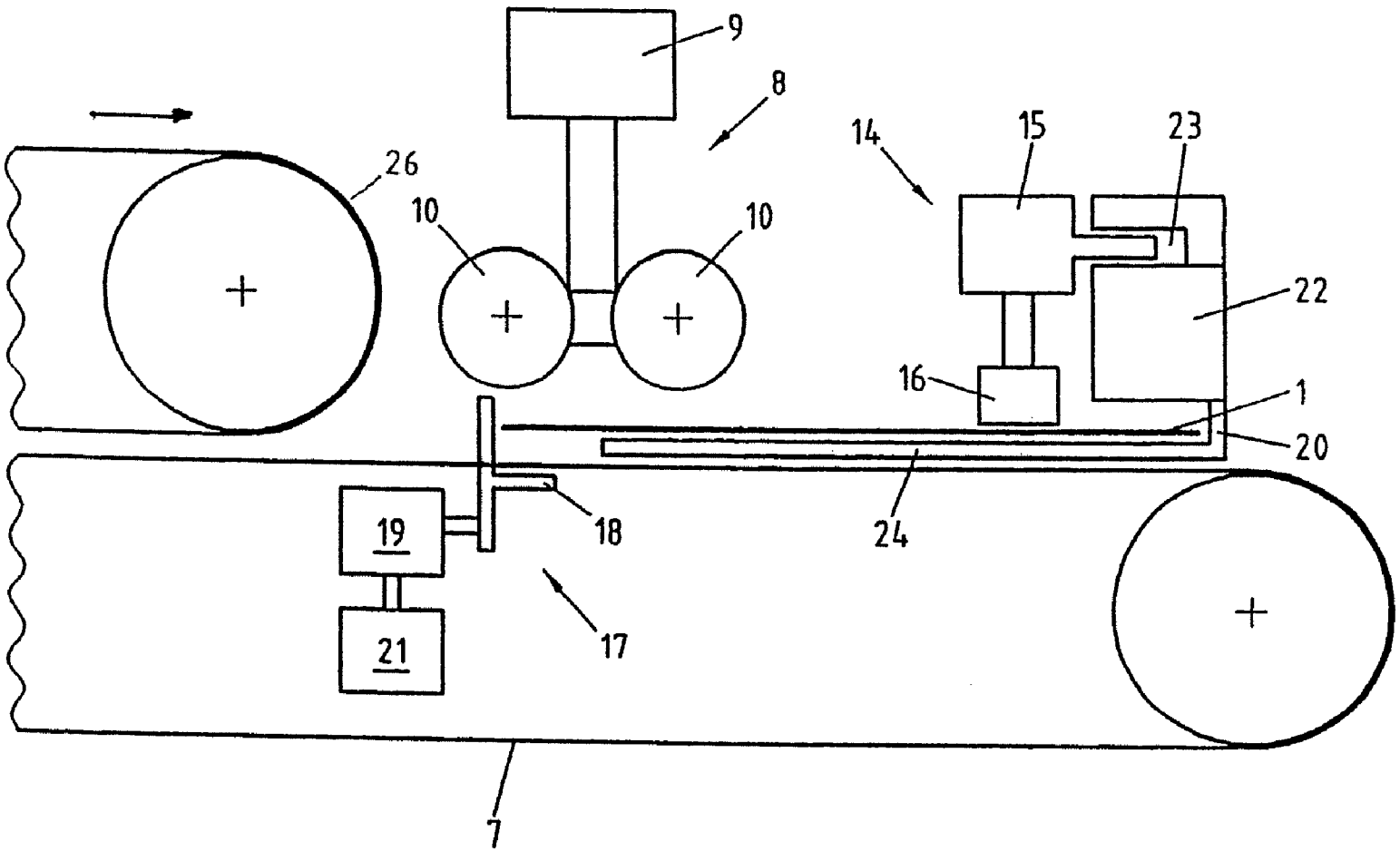

There are a multitude of options for designing and improving the device according to the invention for the handover of bags to a linear transport system. In this context we refer for example not only to the subordinate claims of claim 1, but also to the description of a preferred embodiment in conjunction with the drawing. The drawing shows the following:

FIG. 1 a diagrammatic top view of an embodiment of a device according to the invention for the handover of bags to a linear transport system; and FIG. 2 a more detailed view of the handover region between the device according to the invention and the linear transport system.

The embodiment shown in FIG. 1 of a device according to the invention for the handover of bags 1 to a linear transport system 2 comprises a belt conveyor 3 as a buffer for the bags 1 which are to be fed to the magazine 4 of the feed station 5. The friction belts 6 of the feed station 5 transport the bags 1 individually to a lower transport belt 7 of the linear transport system 2. This transport takes place with the press-on element 8 raised. After a bag 1 has been transported onto the lower transport belt 7, the press-on element 8 is lowered, as a result of which the bag 1 establishes firm contact with the lower transport belt 7. In the embodiment shown, the press-on element 8 comprises a final control element 9 and four press-on rollers 10 (compare FIG. 2).

As soon as the press-on element 8 presses a bag 1 against the lower transport belt 7 of the linear transport system 2, said linear transport system 2 can be put into operation, as a result of which the bags 1 in the belt gap are transported in a cycled manner to processing stations 11, 12 which are shown as examples only. It is clear that the point of bag handover and the processing stations have to be arranged in an equidistant grid in order to make possible cycled processing of the bags 1.

FIG. 1 shows that the device according to the invention for the handover of bags 1 to a linear transport system 2, with belt conveyor 3, feed station 5 and handover region 13, is swivellably arranged in relation to the linear transport system 2. The angle between the device according to the invention and the linear transport system 2, which angle in FIG. 1 is approximately 120°, can thus vary within a wide range. Correspondingly, the bags 1 can be handed over to the linear transport system 2 at various angles. In FIG. 1, the swivel axis A is schematically represented.

The bags 1 are transported from the feed station 5 to a raisable limit stop 14. This limit stop 14 comprises a final control element 15 and a limit stop element 16. As soon as the bags 1 are positioned on the lower transport belt 7 and are fixed on the lower transport belt 7 by means of the press-on element 8, the limit stop element. 16 can be raised in order to ensure proper transport of the bags 1.

Before the press-on element 8 is lowered, precise positioning takes place in that the bags 1 are also centred across the feed direction by means of a centring limit stop 17. To this purpose, a centring limit stop element 18 is moved by a final control element 19 in the direction of a closing limit stop 20, as a result of which the bag 1 is centred between the centring limit stop element 18 and the closing limit stop 20. By way of a further final control element 21, the centring limit stop element 18 is lowerable so that handover of a bag 1 to the linear transport system 2 is not impeded.

Safe infeed of the bags 1 from the feed station 5 to the handover region 13 is ensured by an upper guide element 22 which together with the lower transport belt 7 forms a feed gap for the bags 1. In the embodiment shown a guide rail 23 for adjustable fixing of the limit stop 14 is provided on the upper guide element 22, so that the position of the limit stop 14 can be matched to various bag sizes.

Finally, between the upper guide element 22 and the lower transport belt 7, at least in some sections, a lower guide sheet 24 is arranged which as far as possible prevents the bags 1 establishing contact with the lower transport belt 7—with such contact being detrimental to precise positioning—before the bag 1 is pressed against the lower transport belt 7 by means of the press-on element 8, thus providing precise positioning. As shown in FIG. 1, a recess 25 for the press-on element 8 is provided in this lower guide sheet 24.

For further information about the function of the linear transport system 2, which essentially comprises the lower transport belt 7 and the upper transport belt 26, we refer to the patent application mentioned in the introduction, which patent application has the same filing date.

The invention claimed is:

1. An arrangement comprised of a linear transport system and a device for the handover of bags (1) to the linear transport system (2), wherein the linear transport system comprises an upper transport belt and a lower transport belt (7), characterised in that the device for handover of bags comprises a feed station (5) for individually feeding the bags (1) onto the lower transport belt (7) of the linear transport system (2), and a raisable press-on element (8) above the lower transport belt (7), the press-on element (8) establishing firm contact of the individually fed bags with the lower transport belt (7); and wherein the device for the handover of bags (1) is mounted in a manner enabling a horizontal angle of the device for the handover of bags in relation to the linear transport system (2) to be varied.

2. The arrangement according to claim 1, characterised in that the raisable press-on element (8) comprises at least one roller (10).

3. The arrangement according to claim 2, characterised in that the device for the handover of bags (1) is arranged at a variable angle in relation to the linear transport system (2).

4. The arrangement according to claim 2, characterised in that a raisable limit stop (14) is provided above the lower transport belt (7) in a feed direction of the bags (1) for temporarily stopping movement of the bags on the lower transport belt (7).

5. The arrangement according to claim 2, characterised in that a lowerable centring limit stop (17) is provided which essentially operates across a feed direction of the bags (1) on the lower transport belt (7).

6. The arrangement according to claim 2, characterised in that an upper guide element (22) is provided which forms a feed gap with the lower transport belt (7).

7. The arrangement according to claim 1, characterised in that a raisable limit stop (14) is provided above the lower transport belt (7) in a feed direction of the bags (1) for temporarily stopping movement of the bags on the lower transport belt (7).

8. The arrangement according to claim 7, characterised in that a lowerable centring limit stop (17) is provided which essentially operates across a feed direction of the bags (1) on the lower transport belt (7).

9. The arrangement according to claim 7, characterised in that an upper guide element (22) is provided which forms a feed gap with the lower transport belt (7).

10. The arrangement according to claim 1, characterised in that a lowerable centring limit stop (17) is provided which essentially operates across a feed direction of the bags (1) on the lower transport belt (7).

11. The arrangement according to claim 10, characterised in that an upper guide element (22) is provided which forms a feed gap with the lower transport belt (7).

12. The arrangement according to claim 1, characterised in that an upper guide element (22) is provided which forms a feed gap with the lower transport belt (7).

13. The arrangement according to claim 1, characterised in that a raisable limit stop (14)is provided above the lower transport belt (7) in a feed direction of the bags (1) for temporarily stopping movement of the bags on the lower transport belt (7).

14. The arrangement according to claim 1, characterised in that a lowerable centring limit stop (17) is provided which essentially operates across a feed direction of the bags (1) on the lower transport belt (7).

15. The arrangement according to claim 1, characterised in that an upper guide element (22) is provided which forms a feed gap with the lower transport belt (7).

16. A device for the handover of bags (1) to a linear transport system (2), wherein the linear transport system comprises an upper transport belt and a lower transport belt (7), characterised in that a feed station (5) for individually feeding the bags (1) onto the lower transport belt (7) of the linear transport system (2), and a raisable press-on element (8) above the lower transport belt (7) are provided, the press-on element (8) establishing firm contact of the individually fed bags with the lower transport belt (7);

an upper guide element (22) is provided which forms a feed gap with the lower transport belt (7); and a lower guide sheet (24) is provided extending at least partially between the upper guide element (22) and the lower transport belt (7).

* * * * *